United States Patent [19]

Beckerman

[11] 4,242,974

[45] Jan. 6, 1981

[54] PATTERN FEED ELONGATION IN ELECTRONIC SEWING MACHINE

[75] Inventor: Howard L. Beckerman, Middletown, N.J.

[73] Assignee: The Singer Company, Stamford, Conn.

[21] Appl. No.: 128,996

[22] Filed: Mar. 10, 1980

[51] Int. Cl.[3] ..... D05B 27/22; D05B 3/02

[52] U.S. Cl. ..... 112/158 E; 112/315

[58] Field of Search ..... 112/158 E, 158 R, 303, 112/314, 315

[56] References Cited

U.S. PATENT DOCUMENTS

| | | | |
|---|---|---|---|
| 4,138,955 | 2/1979 | Garron | 112/158 E |
| 4,177,744 | 12/1979 | Wurst et al. | 112/158 E |
| 4,185,571 | 1/1980 | Minalga | 112/158 E |

*Primary Examiner*—Peter P. Nerbun

*Attorney, Agent, or Firm*—Edward P. Schmidt; Robert E. Smith; Edward L. Bell

[57] ABSTRACT

An arrangement for obtaining pattern feed elongation in an electronically controlled sewing machine by utilizing a potentiometer for feed length variation, which potentiometer at a certain point switches in a feed multiplication and reduces its effectiveness so as to obtain a uniform change in feed from 0 to the maximum multiplication desired. Two embodiments are disclosed, one of which utilizes a comparator to eliminate a switch.

3 Claims, 7 Drawing Figures

Fig.1
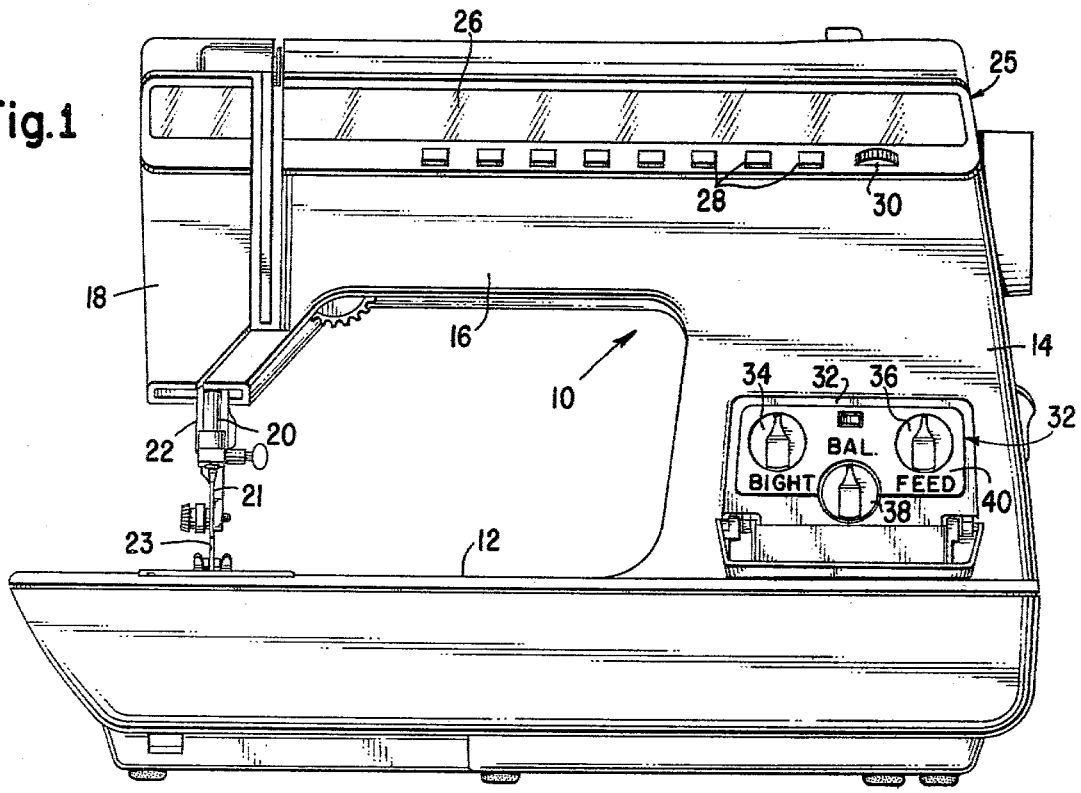
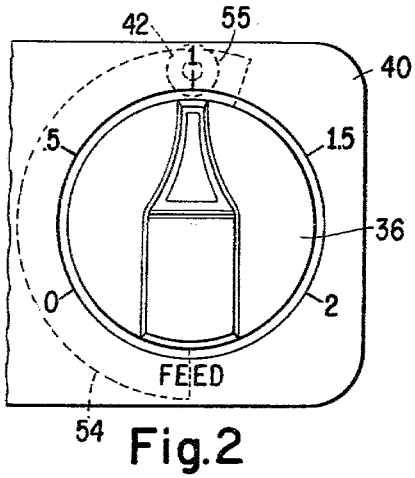
Fig.2
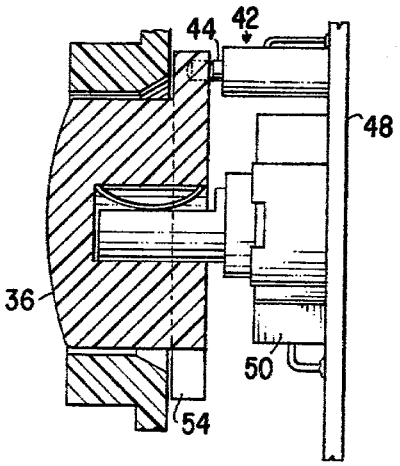
Fig.3
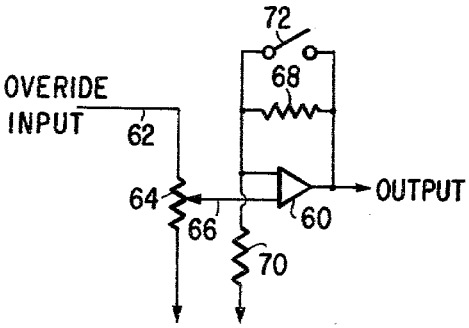
Fig.4
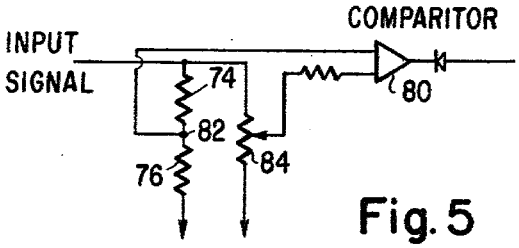
Fig.5

Fig. 6
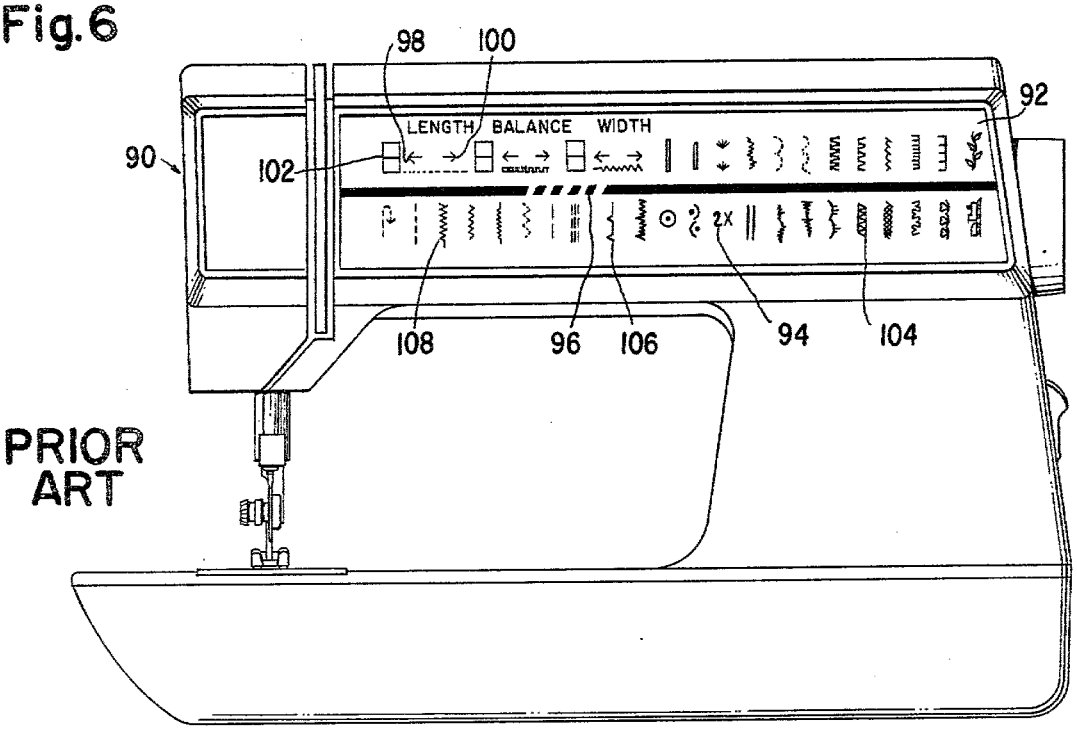
PRIOR ART
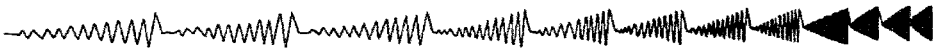
Fig. 7A
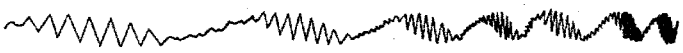
Fig. 7B
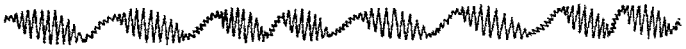
Fig. 7C
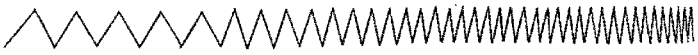
Fig. 7D

PATTERN FEED ELONGATION IN ELECTRONIC SEWING MACHINE

DESCRIPTION

BACKGROUND OF THE INVENTION

This invention relates to sewing machines, more particularly, to continuous pattern feed elongation in an electronically controlled sewing machine.

In heretofore known sewing machines utilizing a cam device and mechanical linkage to retain and transfer needle position information, it is possible to control the length of the pattern simply by adjusting the stitch length of the sewing machine. However, the amount of elongation possible was limited by the stitch length capability of the sewing machine. In certain sewing machines provision was made for adjustably controlling the rotational speed of the cam. Thus, the cam profile represented a continuous locii of points for needle position, bight and, in some cases, feed direction and rate, as opposed to discrete points on the cam profile representing needle position whenever the cam speed is a fixed ratio of the sewing machine speed. Thus, in these heretofore known mechanical sewing machines pattern elongation was possible merely by increasing the ratio between the sewing machine speed and the cam speed. Such a prior art sewing machine is disclosed in the U.S. Pat. No. 3,291,082 issued on Dec. 13, 1966.

With the advent of the electronically controlled sewing machine, stitch pattern information was retained in a solid state memory. Thus, the relationship of cam speed to sewing machine speed was lost. Normally, a position sensor sensitive to arm shaft rotation triggers the release of information from the solid state memory once during each stitch cycle. By including, in an electronically controlled sewing machine, a needle bar control assembly which permits discontinuing end-wise needle reciprocation while continuing with work feeding operations, pattern feed elongation may be obtained. Such a device is disclosed in U.S. Pat. No. 4,138,955, issued on Feb. 13, 1979 to Garron. In that patent, since a number of needle reciprocations could be discontinued, the pattern could be elongated by integral multiples depending upon the number of stitches skipped.

In the U.S. Pat. No. 4,016,821, issued on Apr. 12, 1977 to Minalga, there is disclosed means for controlling, among other things, the feed in an electronically controlled sewing machine so as to be able to reduce the stitch length derived from the information stored in the solid state memory. U.S. Pat. No. 4,177,744, issued Dec. 11, 1979 to Wurst et al, discloses a digital override control for bight and feed in a sewing machine whereby fixed fractions of the signal derived from the solid state memory may be transmitted to the feed actuator in order to attenuate the signal. The sewing machine disclosed in that patent also has the capability for doubling the feed. Thus, by actuating the digital overrides for feed to fractionate the feed signal derived from the solid state memory and by doubling feed cycle between stitches it is possible to attain pattern feed elongation in discrete steps from 0 to 2 times size. However, a smooth transition over that range is not likely because of the difficulty in selecting the proper digital override for feed multiplication to obtain a uniform change from minimum to maximum.

What is required is a device which will permit a sewing machine operator to readily obtain a uniform progression in pattern feed size from 0 to the maximum multiplication thereof.

SUMMARY OF THE INVENTION

The above ends are achieved in one embodiment including a potentiometer for electronic control of the feed, the potentiometer having arranged thereon, a cam for actuating a micro switch to enable the stitch multiplication while, simultaneously, reducing the gain in the linear amplifier controlling feed to one half. Thus, the override pot is rotated over half its scale to obtain full feed from the solid state memory, thereafter engaging the multiplication and reducing the gain on the feed buffer amplifier to one half of the previous gain.

A second embodiment is also disclosed in which the cam and micro switch are not utilized, but the override pot setting is determined in a comparator which may initiate switching the stitch multiplication, and reducing the gain on a feed buffer amplifier.

DESCRIPTION OF THE DRAWINGS

The foregoing will be more readily apparent upon reading the following description in conjunction with the drawings in which:

FIG. 1 is a front elevation of a sewing machine in which an arrangement constructed in accordance with the principles of this invention may be incorporated;

FIG. 2 is an elevation of the feed control knob shown in the sewing machine of FIG. 1;

FIG. 3 is a cross sectional view of the feed control knob shown in FIGS. 1 and 2 with the microswitch actuated thereby;

FIG. 4 is a circuit diagram indicating how a switch may be inserted in circuit to reduce the gain thereof;

FIG. 5 is a circuit diagram indicating how the function of the microswitch shown in FIG. 3 may be accomplished by a second circuit;

FIG. 6 is a front elevation of the prior art sewing machine indicating the digital overrides and the stitch multiplication capability which do not lend themselves to a smooth transition from 0 to maximum stitch; and, FIG. 7A-D is a representation of some of the stitches obtainable in a sewing machine as shown in FIG. 1, indicating the stitch patterns obtainable with a 2X multiplication.

Referring now to FIG. 1, there is shown a sewing machine 10 in which this invention may be incorporated. The sewing machine 10 includes a bed 12 from which rises a standard 14 supporting a bracket arm 16 in overhanging relationship to the bed. The bracket arm 16 terminates in a head end 18 within which is supported an endwise reciprocatory needle bar 20 having a sewing needle 21 affixed to the end thereof. Also supported in the head end 18 behind the needle bar 20 is a presser bar 22 terminating in a presser foot 23, which presser foot urges work material against feed dogs (not shown) supported in the bed 12 of the sewing machine. The bracket arm 16 includes a control board 25 having a panel area 26 behind which there are indicia of the patterns and stitching capabilities of the sewing machine. The control board 25 further includes push buttons 28 for selecting individual patterns from a group of patterns, and further includes a group selector knob 30 for selecting the group from which the individual patterns may be selected.

Supported in the standard 14 is a second control module 32 including therein bight control knob 34, feed control knob 36 and balance control knob 38. For information on the operation of these knobs and their use the reader is referred to U.S. Pat. No. 4,016,821, which issued on Apr. 12, 1977 to Minalga, and which is assigned to the same assignee as the instant application and is hereby incorporated by reference herein. In that patent, it is disclosed that the bight and feed knobs are connected to rheostats which regulate the bypass resistance on buffer operational amplifiers to thereby control the gain of the analog signals derived from the solid state memory prior to transfer into servo amplifiers for regulating the position of the needle bar 20 and the direction and rate of the feed from a feed system supported in the bed 12. The balance control knob 38 is connected to a balance control potentiometer connected as a voltage divider to a double ended reference voltage, and connected only during reverse feed to vary the signal going into a feed servo amplifier so as to permit adjustment of reverse stitching to, for example, appear the same as forward stitching. In the above referenced application, it is taught that the feed control knob 36 when rotated over its entire range will vary the analog signal to the servo amplifier from a minimum value to a maximum equivalent to the digital signal stored in the solid state memory. However, in this invention, the feed control knob 36 is utilized to control feed in the sewing machine and additionally, to automatically actuate the multiplication factor so as to increase the feed rate uniformly from a minimum to the maximum multiplied feed. Thus, for a system in which it is desired to obtain pattern feed elongation of, for example, twice the maximum, the feed control knob 36 is arranged as is shown in FIG. 2. The control plate 40 behind the feed control knob 36 is marked with indicia 0 through 2 at the extremes of rotation of the feed control knob. Where the feed control knob 36 is turned to its minimum setting of 0, the signal derived from the solid state memory is completely attenuated so as to provide no feed. Where the feed control knob 36 is positioned as shown in FIG. 2, directed towards 1, the signal derived from the solid state memory is passed through without attenuation. Where the feed control knob 36 is directed toward the FIG. 2 on the control panel 40, multiplication of the feed length by a factor of 2 has taken place as disclosed in the prior referenced patent, by taking two feed steps while skipping one needle penetration.

FIGS. 3 and 4 indicate one embodiment in which a micro switch 42 is supported on and connected into a circuit board 48 on which the feed control potentiometer 50 is also supported. The micro switch 42 is fashioned with a spring loaded plunger 44 in contact with cam surface 54 which may be molded as part of the feed control knob 36. This cam surface, visible in FIGS. 2 and 3 is fashioned with a ramp portion 55 upon which the plunger 44 of the micro switch may initially impinge so as to be guided into its depressed position. The micro switch 42 is effective in its depressed position to activate the 2X multiplication disclosed in the above referenced patent and to change the gain of a buffer operational amplifier 60 shown in FIG. 4. The buffer operational amplifier 60 is interposed between the digital to analog conversion for the digital data from the solid state memory, and the servo system for the sewing machine. The analog signal derived from the solid state memory is transferred via line 62 to an override potentiometer 64. Line 66 takes the signal from the override potentiometer 64 and transfers the signal to the noninverting terminal of the buffer operational amplifier 60. The resistance 68 is in bypass configuration to the operational amplifier 60 and together with resistance 70 establishes a gain for the operational amplifier. These resistances 68, 70 are arranged to provide a gain of 2 to 1; however, when the switch 72 is closed, the gain is cut to 1 to 1. Simultaneously with the closing of the switch 72 the 2X capability is activated. Thus, when the feed control knob 36 is rotated from the indicia 0 to 1 inscribed upon control panel 40, the gain of the operational amplifier 60 is 2 to 1 so that the output therefrom to the servo system of the sewing machine varies from no signal to the full signal derived from the solid state memory. At the indicia 1 on the control panel 40 the feed control knob 36 actuates the micro switch 42 by initiating the release thereof, causing the electronics in the sewing machine to activate the 2X capability of the sewing machine and closing the switch 72 to cut the gain of the operational amplifier 60 to 1 to 1. Thereby, the output from the operational amplifier 60 is cut to one half and the needle bar 20 of the sewing machine penetrates the work material once for every two feeding cycles. As the feed control knob 36 is rotated further clockwise, the stitch length progressively increases from one half that achieved at a feed control knob setting of 1, until finally at a feed control knob setting of 2 the full feed achieved at a setting of 1 is implemented, but, needle penetrations occur once every two feeding cycles.

It can easily be appreciated that for pattern feed elongation of three times or four times or more, for the first half rotation of the feed control knob 36, the gain of the operational amplifier 60 may be the full multiplication desired. For the second half of the rotation of the feed control knob 36 the gain is one half of full multiplication desired and the 2X multiplication capability may be engaged. Thus, a continuous increase is obtained from zero to the full multiplication desired. Alternatively, a 4X multiplication capability may be utilized and the initial gain of the operational amplifier 60 for a 10X full multiplication may be 10 to 1 whereas the later gain may be 2½ to 1 with a 4X multiplication capability implemented by having one stitch formed for 4 feeding cycles.

Referring now to FIG. 5, there is shown a second embodiment of a circuit which functions to replace the micro switch 42. In this circuit, resistors 74, 76 form a voltage divider which divides the input signal on line 78 in half. A comparator 80 is provided in which the signal from the half way point 82 is compared to the signal from the override pot 84. When the setting of the override pot 84 is beyond half way, the comparator 80 will switch, signalling the multiplication capability to begin skipping stitches so as to multiply feed, and cutting the gain of the operational amplifier 60.

In FIG. 6 there is shown a prior art sewing machine 90, in which the various capabilities and functions may be selected by touching the appropriate indicium on the control panel 92 thereof. Thus, for example, by touching the 2X indicium 94 this capability may be initiated. Similarly, by touching the indicium 96, the override capabilities for length, balance and width are implemented. The program length may be decreased by touching the arrow 98, and increased by touching the arrow 100. A digit 102 is displayed and may be varied over range of 0 to 9. It will be readily understood that in order to attain a uniform pattern elongation some juggling will be required in order to attain a uniform growth which is attained most readily by rotation of a dial in the invention. Where the multiplication capability is 3, 4, 5 or some other integer, achieving uniform feed growth is even more complicated.

Referring now to FIG. 7 there are shown some examples of the pattern feed elongation capability which may be easily implemented with the instant invention. This capability may be implemented for functional as well as aesthetic purposes in order to, for example, obtain better placement of functional zig zag stitches FIG. 7*d*, or when alternating loose and tight patterns for aesthetic reasons FIG. 7*c*.

I claim:

1. An electronically controlled sewing machine comprising a frame, a selectively variable work feeding system supported in said frame, an endwise reciprocating and selectively laterally jogging needle bar supported in said frame, said needle bar terminating in a sewing needle, a solid state memory, means for receiving and converting information from said solid state memory to effect selective lateral jogging of said needle bar and selective variation of said work feeding system, means for obtaining continuous feed length change of the work feeding information received from the solid state memory from 0 to the maximum stored therein, means for achieving additional feed steps between needle penetrations for feed multiplication, and means for combining said obtaining means with said achieving means to obtain a continuous change in said feed length from 0 to the maximum multiplication thereof.

2. An electronically controlled sewing machine as claimed in claim 1 wherein said means for obtaining continuous feed length change of the work feeding information received from the solid state memory includes a potentiometer for proportioning the analog signal derived from said solid state memory; and wherein said combining means includes a means initiated by said potentiometer at a given proportion for instituting a switching operation, and an amplifier having as an input thereto the proportioned analog signal and having a gain equivalent to said maximum multiplication, said instituting means instituting, when initiated, a reduction in said gain of said amplifier so that the product of said reduced gain times said feed multiplication of said means for achieving additional feed steps equals said maximum multiplication.

3. An electronically controlled sewing machine as claimed in claim 2 wherein said instituting means is implemented by a cam track carried by said potentiometer and a micro switch actuated by said cam track at a given proportion of said analog signal.

* * * * *